US005248653A

United States Patent [19]

Sakata et al.

[11] Patent Number: 5,248,653

[45] Date of Patent: Sep. 28, 1993

[54] THERMAL TRANSFER DYESHEET

[75] Inventors: Kazuhiko Sakata, Ibaraki, Japan; Warren T. Smith, Sydney, Australia; Richard A. Hann; Barry Pack, both of Suffolk, England

[73] Assignee: Imperial Chemical Industries PLC, London, United Kingdom

[21] Appl. No.: 704,980

[22] Filed: May 24, 1991

[30] Foreign Application Priority Data

May 25, 1990 [GB] United Kingdom ..... 9011826.6

[51] Int. Cl.[5] ..... B41M 5/035; B41M 5/38

[52] U.S. Cl. ..... 503/227; 428/195; 428/500; 428/704; 428/913; 428/914

[58] Field of Search ..... 8/471; 428/195, 500, 428/704, 913, 914; 503/227

[56] References Cited

U.S. PATENT DOCUMENTS

| | | | |
|---|---|---|---|
| 4,559,273 | 12/1985 | Kutsukake et al. | 428/484 |
| 4,631,232 | 12/1986 | Ikawa et al. | 428/413 |
| 4,720,480 | 1/1988 | Ito et al. | 503/227 |
| 4,737,485 | 4/1988 | Henzel et al. | 503/227 |
| 4,950,641 | 8/1990 | Hann et al. | 503/227 |
| 4,981,748 | 1/1991 | Kawai et al. | 428/216 |

FOREIGN PATENT DOCUMENTS

| | | | |
|---|---|---|---|
| 153880 | 9/1985 | European Pat. Off. | 503/227 |
| 314205 | 5/1989 | European Pat. Off. | 503/227 |
| 314348 | 5/1989 | European Pat. Off. | 503/227 |
| 329117 | 8/1989 | European Pat. Off. | 503/227 |

OTHER PUBLICATIONS

Patent Abstracts of Japan, vol. 12, No. 267, Jul. 26, 1988; vol. 12, No. 67, Mar. 2, 1988; vol. 10, No. 134, May 17, 1986; vol. 13, No. 177, Apr. 26, 1989.

Japanese Patents Gazette, No. 86-194027/80.

*Primary Examiner*—Bruce H. Hess

*Attorney, Agent, or Firm*—Cushman, Darby & Cushman

[57] ABSTRACT

A dyesheet is provided for thermal transfer printing, comprising a base sheet having a dyecoat containing a thermal transfer dye layer on one surface, and on the other a croselinked heat resistant backcoat formulated to minimize dye migration from the dyecoat to the backcoat during storage. The backcoat comprises the reaction product of radically copolymerising in a layer of coating composition, a) at least one organic compound having a plurality of radically polymerisable unsaturated groups per molecule, and b) at least one organic compound having per molecule a single unsaturated group radically copolymerisable with constituent a, and having at least one alicyclic group per molecule. Preferred additional constituents include slip agents, especially a multivalent metal salt of a long chain alkyl or alkylphenyl phosphate ester.

6 Claims, No Drawings

THERMAL TRANSFER DYESHEET

The invention relates to dyesheets for thermal transfer printing, which are suitable for forming printed images on receiver sheets by thermal transfer of dyes using such heating means as thermal heads; and in particular to novel backcoats resistant to dye migration from the dyecoat to the backcoat during storage.

Thermal transfer printing is a process for printing and generating images by transferring thermally transferable dyes from a dyesheet to a receiver. The dyesheet comprises a base sheet coated on one side with a dyecoat containing one or more thermally transferable dyes, and printing is effected while the dyecoat is held against the surface of the receiver, by heating selected areas of the dyesheet so as to transfer the dyes from those selected areas to corresponding areas of the receiver, thereby generating images according to the areas selected. Thermal transfer printing using a thermal head with a plurality of tiny heaters to heat the selected areas, has been gaining widespread attention in recent years mainly because of its ease of operation in which the areas to be heated can be selected by electronic control of the heaters, eg according to a video or computer-generated signal; and because of the clear, high resolution images which can be obtained in this manner.

The base sheet of a thermal transfer dyesheet is generally a thermoplastic film, orientated polyester film usually being selected because of its superior surface smoothness and good handling characteristics. The thermoplastic materials used in such films, however, may lead to a number of problems. For example, for high resolution printing at high speed, it is necessary to provide the thermal stimulus from the heaters in pulses of very short duration to enable all the rows to be printed sequentially within an acceptably short time, but this in turn requires higher temperatures in the printer head in order to provide sufficient thermal energy to transfer sufficient dye in the time allowed. Typically such temperatures are well in excess of the melting or softening temperatures of the thermoplastic base sheet. One effect of such high temperatures can be localised adhesion between the dyesheet and the printer head, the so-called "sticking" effect, with a result that the dyesheet is unable to be moved smoothly through the printer. Printing may be accompanied by a series of clicks as the sheets become stuck to, then freed from, the apparatus, this becoming a chatter-like noise at higher frequencies. In severe cases the base sheet can lose its integrity, and the dyesheet become torn.

In the past, these problems have been addressed by providing the dyesheet with one or more protective backcoats of various heat-resistant, highly crosslinked, polymers. By "backcoats" in this context we mean coatings applied either directly or indirectly on the base sheet surface remote from that to which the dyecoat is applied. Thus it is to the backcoat side to which heat is applied by the thermal head during printing. Backcoats are desirably also formulated to improve slip and handling properties, but if not correctly formulated for an optimum balance of properties, they can also contribute to problems during storage and printing.

Dyesheets are usually stored in a rolled up state with the dyecoat of one part pressed against the back of the dyesheet further along its length. Most thermal transfer dyes have an affinity for thermoplastics such as the polyesters of the base sheet, and for some of the backcoats previously proposed. Under such conditions some of the dye will tend to migrate from the dyecoat to the back of the base sheet or any overlying backcoat. One consequence of this is that the thermal head may become contaminated with dye when printing. Also, in dyecoats containing panels of more than one colour, some dye migration on the rolled up dyesheet can lead to colour contamination of the colour panels themselves. Thus potential dye migration needs to be considered when selecting the polymerisable materials (and indeed all the constituents) of the coating composition.

A vide variety of highly crosslinked polymer compositions have been proposed for heat resistant backcoats over many years past. Particularly effective of such compositions in respect of their overall balance of properties, being those described in EP-A-314,348. Such compositions are based on organic resins having a plurality of pendent or terminal acrylic groups per molecule available for crosslinking, especially those having 4–8 such groups, these being cross-linked after application to the base film surface, so as to form a strong heat-resistant layer. These polyfunctional resins were used in combination with linear organic polymers, which did not copolymerise with them during crosslinking but which had an important effect on the physical properties of the coating. Various slip agents, antistatic agents and small solid particles were also included in the coating composition to contribute to the handling and slip properties of the backcoat.

We have now found that backcoats which are particularly resistant to dye migration can be produced by copolymerising certain monofunctional compounds with the polyfunctional compound, either replacing or additional to the linear organic polymer.

Accordingly, the present invention provides a thermal transfer printing dyesheet comprising a base sheet having a thermal transfer dye layer on one surface and a backcoat on the other surface, wherein the backcoat comprises the reaction product of radically copolymerising in a layer of coating composition, the following compounds as essential constituents:

a) at least one organic compound having a plurality of radically polymerisable unsaturated groups per molecule, and b) at least one organic compound having per molecule a single unsaturated group radically copolymerisable with constituent a, and having at least one alicyclic group per molecule.

When the radically polymerisable groups have been copolymerised, the cross-linked polyfunctional materials provide the backcoat with improving hardness and thermal properties as the number of unsaturated groups per molecule increases, thereby increasingly avoiding sticking during printing. Polyfunctional compounds with more than about 8 unsaturated groups per molecule lead to coatings having very good thermal properties, but this may be at the expense of flexibility. Hence we prefer to restrict the bulk (at least 95% by weight) of our polyfunctional constituent a to compounds with only 2–8, preferably 2–6, radically polymerisable unsaturated groups per molecule.

Examples of polyfunctional compounds having just two radically polymerisable unsaturated groups per molecule and suitable for use as or as part of constituent a of this composition, include 1,6-hexandiol di(meth)acrylate (the designation "(meth)" being used herein to indicate that the methyl group in optional, i.e. referring here to both 1,6-hexandiol dimethacrylate and 1,6-hexandiol diacrylate), ethylene glycol di(meth)acrylate, diethylene glycol di(meth)acrylate, triethyleneglycol di(meth)acrylate, tetraethylene glycol di(meth)acrylate, polyethylene glycol di(meth)acrylate, tripropylene glycol di(meth)acrylate, polypropylene glycol di(meth)acrylate, and neopentyl glycol di(meth)acrylate.

Examples of compounds having three or more radically polymerisable unsaturated groups suitable for use as or as part of constituent a, include trimethylol propane tri(meth)acrylate, pentaerythritol tri(meth)acrylate, pentaerithritol tetra(meth)acrylate, and dipentaerythritol hexa(meth)acrylate. Other examples include compounds having three or more radically polymerisable groups corresponding to the di-functional compounds above, including esters of (meth)acrylic acid with polyester polyols and polyether polyols which are obtainable from a polybasic acid and a polyfunctional alcohol, urethane (meth)acrylates obtained through a reaction of a polyisocyanate and an acrylate having a hydroxy group, and epoxy acrylates obtained through a reaction of an epoxy compound with acrylic acid, an acrylate having a hydroxy group or an acrylate having a carboxyl group.

Examples of monofunctional compounds suitable for use in constituent b. i.e. compounds having a single radically polymerisable unsaturated group and at least one alicyclic group per molecule, include cyclohexyl (meth)acrylate, isobornyl (meth)acrylate, dicyclopentanyl (meth)acrylate, and dicyclopentadienyl (meth)acrylate.

The proportion of constituent a in the total weight of radically polymerisable compounds, is preferably more then 5% and less than 95% by weight, with constituent b varying correspondingly from less than 95% to more than 5% by weight. Leas than 5% by weight of constituent a can result in problems during manufacture from inferior curing and coating characteristics (due to low solution viscosity), and resulting in backcoats having reduced heat resistance characteristics, compared with those containing relatively greater amounts of constituent a. However, if the proportion of constituent a exceeds 95% by weight, scratching increasingly results. Generally we prefer to weight this balance of properties in favour of thermal stability, by having an excess of constituent a over constituent b. Our preferred composition has the polymerisable constituents in the proportions of a 50–90% and b correspondingly 50–10% by weight, depending on the specific balance of properties desired.

In order to make such a heat resistant backcoat of the above mentioned radically polymerisable compounds on a base sheet of a thermal transfer printing dyesheet, a coating composition solution containing them is applied as a layer onto the base sheet, any solvent removed by drying, and then the resultant layer cured by heating or by irradiating with electromagnetic radiation. In addition to the above mentioned radically polymerisable compounds, this coating solution may include such radical polymerisation initiators and activators as may be required for the polymerisation method being used, togather with UV absorbers and other stabilisers if desired.

Suitable solvents include alcohols, ketones, esters, aromatic hydrocarbons, and halogenatated hydrocarbons. The quantity of solvent required is that which provides a solution viscosity having good coating characteristics.

Examples of suitable radical polymerisation initiators, include benzophenone, benzoin, such benzoin ethers as benzoin methyl ether and benzoin ethyl ether, such benzyl ketals as benzyl dimethyl ketal, such acetophenones as diethoxy acetophenone and 2-hydroxy-2-methyl propiophenone, such thioxanthones as 2-chlorothioxanthones and isopropyl-thioxanthone, such anthraquinones as 2-ethyl-anthraquinone and methylanthrequinone (the above normally being in the presence of an appropriate amine, eg Quantacure ITX (a thioxanthone) in the presence of guanacure EPD (an aromatic amine), both from Ward Blenkineop), such azo compounds as azobisimobutyronitrile, such organic peroxides as benzoyl peroxide, lauryl peroxide, di-t-butyl peroxide, and cumyl peroxide. Other examples of commercially available systems include Igacure 907 from Ciba Geigy, and Uvecryl P101 from UCB. The quantity of these radical polymerisation initiators used in the polymerisation is 0.01–15% by weight of the aforementioned radically polymerisable compounds.

Various other additives may also beneficially be added to the coating solution. These may include, for example, such stabilising agents as polymerisation inhibitors and oxidation inhibitors. Inorganic fine powders, slip agents, silicone oils, antistatic agents and surfactants, may also be included in the coating composition to give the backcoat good slipping character. In particular, our preferred backcoat composition contains in addition to constituents a and b at least one slip agent selected from derivatives (especially metal salts) of long chain carboxylic and phosphoric acids, long alkyl chain eaters of phosphoric acid, and long alkyl chain acrylates; an antistatic agent, and a solid particulate antiblocking agent leas than 5 μm in diameter. Particularly favoured slip agents are metallic salts of a phosphate esters expressed by the following general formula (A) or (B):

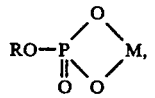

(A)

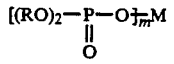

(B)

in which R is an alkyl group of $C_{8-30}$ or an alkylphenyl group, m is an integral number of 2 or 3, and M a metal atom.

The preferred quantity of the slip agent in the composition lies within the range 1–20% by weight, of the total amount of the radically polymerisable compounds of constituents a and b. If the proportion drops below about 1% by weight, the coating will not overcome poor slip characteristics, and problems such as scratching and poor travelling characteristics of the thermal transfer dyesheet over the thermal head may increasingly occur. The upper limit is one of compromise depending on the materials used. As the proportion reaches 10% by weight, very good slip properties can be obtained, but dye sheet stability may thereafter increasingly become a problem with some materials, particularly as the proportion exceeds 20%.

Linear organic polymers, such as (meth)acrylic polymers, polyesters and polycarbonates can also be added to reduce shrinkage of the backcoat when curing, and to modify the physical properties of the cured coating.

Thus a preferred dyesheet is one in which in addition to constituents a and b, the backcoat also contains as further constituent c at least one linear organic polymer in amount within the range 1–20% by weight of the total amount of the radically polymerisable compounds of constituents a and b.

Various coating methods may be employed, including, for example, roll coating, gravure coating, screen costing and fountain coating. After removal of any solvent, the coating can be cured by heating or by irradiating with electromagnetic radiation, such as ultraviolet light, electron beams and gamma rays, as appropriate. Typical curing conditions are heating at 50°–150° C. for 0.5–10 minutes (in the case of thermal curing), or exposure to radiation for 1–60 s from an ultraviolet lamp of 80 W/cm power output, positioned about 15 cm from the coating surface (in case of ultraviolet light curing). In-line UV curing may utilise a higher powered lamp, eg up to 120 W/cm power output, focused on the coating as it passes the lamp in about 0.1–10 ms. The coating is preferably applied with a thickness such that after drying and curing the backcoat thickness is 0.1–5 μm, preferably 0.5–3 μm, and will depend on the concentration of the coating composition.

The backcoat of the invention will benefit dyesheets with a variety of base sheets, including polyester film, polyamide film, polyimide film, polycarbonate film, polysulfone film, cellophane film and polypropylene film, as examples. Orientated polyester film is most preferred, in view of its mechanical strength, dimensional stability and heat resistance,. The thickness of the base sheet is suitably 1–30 μm, and preferably 2–15 μm.

The dyecoat is similarly formed by coating the base sheet with an ink prepared by dissolving or dispersing a thermal transfer dye and a binder resin to form a coating composition, then removing any volatile liquids and curing the resin. Any thermal transfer dye may be selected as required, e.g. from such nonionic dyes as azo dyes, anthraquinone dyes, azomethine dyes, methine dyes, indoaniline dyes, naphthoquinone dyes, quinophthalone dyes or nitro dyes. The binder can be selected from such known polymers as polycarbonate, polyvinylbutyral, and cellulose polymers, such as methyl cellulose, ethyl cellulose, and ethyl hydroxyethyl cellulose, for example.

The ink may include dispersing agents, antistatic agents, antifoaming agents, and oxidation inhibitors, and can be coated onto the base sheet as described for formation of the backcoat, or may overlie a cross-linked dye barrier layer, eg as described in EP-A-341,349. The thickness of the dyecoat is suitably 0.1–5 μm, preferably 0.5–3 μm.

Printing and/or generation of images through the use of a thermal transfer printing dyesheet of the invention, is carried out by placing the dyecoat against a receiver sheet, and heating from the back surface of the dyesheet by means of a thermal head heated in accordance with electric signals delivered to the head.

EXAMPLES

The invention is nov illustrated by specific examples of dyesheets, prepared according to the invention as described in Examples 1–4 below, reference also being made to other dyesheets prepared for comparative purposes in the Comparative Examples A and B, that follow them.

Each backcoat was then assessed by the following qualitative and semi-quantitative tests:

1) Sticking - the dyesheet was placed with its dyecoat against a receiver sheet and transfer printing commenced using a a Kyocera KMT 85 thermal head, having 6 dot/mm of heating element density. Printing was carried out one row at a time in normal manner, with the two sheets incrementally moved through the printer after each row was printed. Electric power of 0.32 W/dot was applied for 10 ms to each heater so an to heat the backcoat, and thereby cause transfer of the dye over an ares 5 cm long and 8 cm wide. Following printing, assessment of the extent of adhesion between the thermal head and the dyesheet by melting, was made by microscopic inspection of the thermal head.
2) Scratching - thermal transfer was performed as described above, and the number of vertical streaks generated on the printed image was measured.
3) Dye migration - to evaluate dye migration, a portion of dyesheet 10 cm long and 5 cm wide was placed with its dyecoat against the backcoat of a further similar portion, and these were pressed together with a pressure of 10 g/cm$^2$. While maintaining this pressure, they were stored in an oven at 60° C. for 3 days, and the colour density of the dye that had migrated into the backcoat was measured using a reflection type densitometer (Sakura Densitometer PDA 65).

The results of all these test on dyesheets according to the invention and on comparative dyesheets, are respectively given in Tables 1 and 2 below.

Example 1

Preparation of Thermal Transfer Dyesheet 1

A coating composition for providing a heat resistant backcoat was prepared as a homogenous dispersion, from the following constituents, where the quantities are parts by weight, and the functionality refers to the number of radically polymerisable unsaturations per molecule:

| Coating composition for preparing backcoat 1: | | |
|---|---|---|
| a | urethane acrylate (Ebecryl 220) (hexa-functional compound) | 60 parts |
| b | mono-functional isobornyl acrylate | 26 parts |
| c | polymethylmethacrylate (Diakon LG156 from ICI) | 14 parts |
| | antistatic agent (Atmer 129 from ICI) | 1 part |
| | zinc stearyl phosphate | 5 parts |
| | talc (as ultra-fine powder, mean particle size 1.0 μm) | 5 parts |
| | thioxanthone photoinitiator | 1.7 parts |
| | aromatic amine photosensitiser | 1.7 parts |
| | acetophenone photoinitiator | 3.4 parts |
| | polymerisable amine photosensitiser | 3.4 parts |
| | methyl ethyl ketone | 150 parts |

The dispersion was coated onto one surface of 6 μm thick polyester film using a standard No 3 wire-bar. After removal of the solvent in a draught of warm air, the coating was irradiated with ultraviolet light for 10 seconds using an 80 W/cm ultraviolet irradiation apparatus (UVC-2534, manufactured by Ushio) held 15 cm from the coating surface, thereby to produce a heat resistant slipping layer of 1 μm thickness.

A coating composition for providing a dyecoat was then prepared as a solution from the following materials:

| Dyecoat coating composition | |
|---|---|
| disperse dye (Dispersol Red B-2B from ICI) | 4 parts |
| ethyl cellulose resin (Hercules) | 4.4 parts |
| tetrahydrofuran | 90 parts |

This coating composition was applied onto the front surface of the base film backcoated as above, i.e. onto that surface of the base film remote from the backcoat, using a No 10 wire-bar. The solvent was then removed to leave a dyecoat of 1.0 μm thickness, thereby completing the thermal transfer printing dyesheet 1.

Preparation of Receiver Sheet

A coating composition for forming a receiver layer was prepared as a solution from the following materials:

| Receiver coating composition | |
|---|---|
| polyester resin | 80 parts |
| amino-silicone | 20 parts |
| epoxy-silicone | 15 parts |
| 1,4-diazo-bicycloctane | 5 parts |
| methyl ethyl ketone | 80 parts |

Using a polyester film of 100 μm thickness (Nelinex 990 from ICI) as a base sheet, this receiver coating composition was applied to the polyester film by means of a wire bar No. 36. After removal of the solvent, a receiver layer of about 5 μm thickness was obtained. This base sheet having a single coating of receiver layer was used as the receiver sheet in the following evaluations.

The dyesheet and the receiver sheet prepared as above, were placed together so that the dyecoat was positioned against the receiver layer, and an area printed using the Kyocera thermal head. No sticking between the thermal head and the dyesheet was detected, the latter running smoothly through the printer without producing any wrinkling. No scratching was detected in the formed image.

Dye migration was evaluated as described above. A very low reflection density of 0.09 was recorded.

Examples 2 to 9

A series of further dyesheets (Dyesheets 2 to 9 respectively) was prepared in the manner of Example 1, but with alternative backcoats according to the invention. The coating compositions used different mixtures of polymerisable compounds and additives, but the same quantity of the same photoinitiators, photosensitisers and solvent as were used in Example 1. The coating compositions were as follows:

| | Backcoat coating composition 2 | |
|---|---|---|
| a | urethane acrylate (Ebecryl 220) (hexa-functional compound) | 70 parts |
| b | mono-functional isobornyl acrylate | 25 parts |
| d | polymethylmethacrylate (Diakon LG156 from ICI) | 5 parts |
| c | zinc stearyl phosphate | 5 parts |
| | talc (as ultra-fine powder, mean particle size 1.0 μm) | 5 parts |
| | antistatic agent (Atmer 129 from ICI) | 1 part |
| | thioxanthone photoinitiator | 1.7 parts |
| | aromatic amine photosensitiser | 1.7 parts |
| | acetophenone photoinitiator | 3.4 parts |
| | polymerisable amine photosensitiser | 3.4 parts |
| | methyl ethyl ketone | 150 parts |

-continued

| | Backcoat coating composition 3 | |
|---|---|---|
| a | dipentaerylthritol hexaacrylate (hexa-functional compound) | 40 parts |
| a | pentaerylthritol acrylate (tri-functional compound | 30 parts |
| b | dicyclopentanyl acrylate (mono-functional compound) | 20 parts |
| c | polymethylmethacrylate (Diakon LG156 from ICI) | 10 parts |
| | antistatic agent (Atmer 129 from ICI) | 1 part |
| | zinc stearyl phosphate | 5 parts |
| | talc (ultra-fine powder; mean particle size of 1.0 μm) | 5 parts |
| | thioxanthone photoinitiator | 1.7 parts |
| | aromatic amine photosensitiser | 1.7 parts |
| | acetophenone photoinitiator | 3.4 parts |
| | polymerisable amine photosensitisor | 3.4 parts |
| | methyl ethyl ketone | 150 parts |
| | Backcoat coating composition 4 | |
| a | urethane acrylate (Ebecryl 220) (hexa-functional compound) | 40 parts |
| b | mono-functional isobornyl acrylate | 20 parts |
| b | dicyclopentanyl acrylate | 25 parts |
| c | polymethylmethacrylate (Diakon LG156 from ICI) | 15 parts |
| | zinc stearyl phosphate | 5 parts |
| | talc (as ultra-fine powder, mean particle size 1.0 μm) | 5 parts |
| | antistatic agent (Atmer 129 from ICI) | 1 part |
| | thioxanthone photoinitiator | 1.7 parts |
| | aromatic amine photosensitiser | 1.7 parts |
| | acetophenone photoinitiator | 3.4 parts |
| | polymerisable amine photosensitisor | 3.4 parts |
| | methyl ethyl ketone | 100 parts |
| | Backcoat coating composition 5 | |
| a | urethane acrylate (Ebecryl 220) (hexa-functional compound) | 30 parts |
| b | mono-functional isobornyl acrylate | 30 parts |
| b | dicyclopentanyl acrylate | 25 parts |
| c | polymethylmethacrylate (Diakon LG156 from ICI) | 15 parts |
| | zinc stearyl phosphate | 5 parts |
| | talc (as ultra-fine powder, mean particle size 1.0 μm) | 5 parts |
| | antistatic agent (Atmer 129 from ICI) | 1 part |
| | thioxanthone photoinitiator | 1.7 parts |
| | aromatic amine photosensitiser | 1.7 parts |
| | acetophenone photoinitiator | 3.4 parts |
| | polymerisable amine photosensitisor | 3.4 parts |
| | methyl ethyl ketone | 90 parts |
| | Backcoat coating composition 6 | |
| a | pentaerythritol triacrylate (tri-functional compound) | 30 parts |
| a | urethane acrylate modified with polycarbonate (di-functional) | 30 parts |
| b | isobornyl acrylate (mono-functional compound) | 40 parts |
| | zinc stearyl phosphate | 5 parts |
| | talc (as ultra-fine powder, mean particle size: 1.0 μm) | 5 parts |
| | antistatic agent (Atmer 129 from ICI) | 1 part |
| | thioxanthone photoinitiator | 1.7 parts |
| | aromatic amine photosensitiser | 1.7 parts |
| | acetophenone photoinitiator | 3.4 parts |
| | polymerisable amine photosensitisor | 3.4 parts |
| | methyl ethyl ketone | 150 parts |
| | Backcoat coating composition 7 | |
| a | urethane acrylate (Ebecryl 220) (hexa-functional compound) | 10 parts |
| a | epoxyacrylate (Ebecryl 600) (di-functional compound) | 76 parts |
| b | Isobornyl acrylate (mono-functional compound) | 14 parts |
| | zinc stearyl phosphate | 5 parts |
| | talc (as ultra-fine powder, mean particle size: 1.0 μm) | 5 parts |
| | antistatic agent (Atmer 129 from ICI) | 1 part |
| | thioxanthone photoinitiator | 1.7 parts |
| | aromatic amine photosensitiser | 1.7 parts |

-continued

| | | |
|---|---|---|
| | acetophenone photoinitiator | 3.4 parts |
| | polymerisable amine photosensitisor | 3.4 parts |
| | methyl ethyl ketone | 150 parts |
| | Backcoat coating composition 8 | |
| a | urethane acrylate (Ebecryl 220) (hexa-functional compound) | 60 parts |
| b | mono-functional isobornyl acrylate | 26 parts |
| c | polymethylmethacrylate (Diakon LG156 from ICI) | 14 parts |
| | zinc stearyl phosphate | 3 parts |
| | talc (as ultra-fine powder, mean particle size 1.0 μm) | 7 parts |
| | antistatic agent (Atmer 129 from ICI) | 1 part |
| | thioxanthone photoinitiator | 1.7 parts |
| | aromatic amine photosensitiser | 1.7 parts |
| | acetophenone photoinitiator | 3.4 parts |
| | polymerisable amine photosensitisor | 3.4 parts |
| | methyl ethyl ketone | 150 parts |
| | Backcoat coating composition 9 | |
| a | urethane acrylate (Ebecryl 220) (hexa-functional compound) | 60 parts |
| b | mono-functional isobornyl acrylate | 26 parts |
| c | polymethylmethacrylate (Diakon LG156 from ICI) | 14 parts |
| | zinc stearyl phosphate | 10 parts |
| | talc (as ultra-fine powder, mean particle size 1.0 μm) | 7 parts |
| | antistatic agent (Atmer 120 from ICI) | 1 part |
| | thioxanthone photoinitiator | 1.7 parts |
| | aromatic amine photosensitiser | 1.7 parts |
| | acetophenone photoinitiator | 3.4 parts |
| | polymerisable amine photosensitisor | 3.4 parts |
| | methyl ethyl ketone | 150 parts |

Dyesheets 2 to 9 were each prepared from the above dispersion of like number. The appropriate dispersion was coated onto one surface of 6 μm thick polyester base film, the solvent removed and the coating cured using the same procedure as described in Example 1, thereby to provide the base film with a heat resistant backcoat. The dyesheet was then completed by the provision of a dyecoat using the same composition as was used in Example 1.

Sticking, scratching and dye migration were evaluated for each dyesheet by using fresh portions of the same receiver sheet, and employing the same methods, as described in Example 1. The results are given in Table 1.

Comparative Examples A and B

Two further dyesheets (A and B) were prepared in the manner of Example 1, but with alternative backcoats outside the present invention. In composition A there is present no mono-functional alicyclic constituent b, two polyfunctional compounds being used, one being hexa-functional and the other having di-functionality. In composition B, two polyfunctional compounds were again used without any monofunctional alicyclic compounds, but the solvent level has been raised towards that used in Example 1. The coating compositions were as follows:

| | | |
|---|---|---|
| | Backcoat coating composition (A) | |
| a | urethane acrylate (Ebecryl 220) (hexa-functional compound) | 80 parts |
| a | polyester acrylate (Ebecryl 810) (di-functional compound) | 20 parts |
| | zinc stearyl phosphate | 5 parts |
| | talc (as ultra-fine powder, mean particle size: 1.0 μm) | 5 parts |
| | antistatic agent (Atmer 129 from ICI) | 1 part |
| | thioxanthone photoinitiator | 1.7 parts |
| | aromatic amine photosensitiser | 1.7 parts |

-continued

| | | |
|---|---|---|
| | acetophenone photoinitiator | 3.4 parts |
| | polymerisable amine photosensitisor | 3.4 parts |
| | methyl ethyl ketone | 80 parts |
| | Backcoat coating composition (B) | |
| a | trimethylolpropane triacrylate (tri-functional compound) | 70 parts |
| a | 1,6-hexandiol diacrylate (di-functional compound) | 30 parts |
| | zinc stearyl phosphate | 5 parts |
| | talc (as ultra-fine powder, mean particle size: 1.0 μm) | 5 parts |
| | antistatic agent (Atmer 129 from ICI) | 1 part |
| | thioxanthone photoinitiator | 1.7 parts |
| | aromatic amine photosensitiser | 1.7 parts |
| | acetophenone photoinitiator | 3.4 parts |
| | polymerisable amine photosensitisor | 3.4 parts |
| | methyl ethyl ketone | 100 parts |

Dyesheets A and B were each prepared from the above dispersions identified by like letter codes. The appropriate dispersion was coated onto one surface of 6 μm thick polyester base film, the solvent removed and the coating cured using the same procedure as described in Example 1, thereby to provide the base film with a heat resistant backcoat. The dyesheet was then completed by the provision of a dyecoat, again using the same composition, as that used in Example 1.

Sticking, scratching and dye migration were evaluated for each dyesheet by using fresh portions of the same receiver sheet, and employing the same methods, as described in Example 1. The results are given in Table 2.

TABLE 1

| Example | Sticking | Scratching No of streaks | Dye migration reflective density |
|---|---|---|---|
| 1 | none | 0 | 0.09 |
| 2 | none | 0 | 0.08 |
| 3 | none | 0 | 0.07 |
| 4 | none | 0 | 0.09 |
| 5 | none | 0 | 0.08 |
| 6 | none | 0 | 0.06 |
| 7 | none | 0 | 0.07 |
| 8 | none | 0 | 0.08 |
| 9 | none | 0 | 0.08 |

TABLE 2

| Example | Sticking | Scratching No of streaks | Dye migration reflective density |
|---|---|---|---|
| A | none | >100 | 0.25 |
| B | none | ca. 30 | 0.20 |

Comparison of the results in Tables 1 and 2 demonstrates the useful improvement in the balance of properties we have found when using the backcoats of the present invention. Thus not only does the improved freedom from dye migration demonstrate how these preferred backcoats can provide an improved stability that will enable the dyesheet to be stored for relatively long periods before use, but the freedom from sticking and scratching also indicate good mechanical performance that can be expected during printing.

Examples 10 to 14

To illustrate further the comparatively low dye migration obtainable with the present dyesheets, a further series of compositions was prepared as before and tested for dye migration, using Disperol Red B-2B dyecoats of the same formulation as those above. The backcoat compositions were as follows.

| | | |
|---|---|---|
| | Backcoat coating composition 10 | |
| a | urethane acrylate (Ebecryl 220+) (hexa-functional compound) | 60 parts |
| b | isobornyl acrylate (Kyoeisha Yushi) (mono-functional alicyclic compound) | 26 parts |
| c | Diakon LG156 (ICI) (polymethylmethacrylate | 14 parts |
| | zinc stearate (Sakai Chem Industries) | 5 parts |
| | talc (Fuji Talc) ultra-fine powder, mean particle size: 1.0 μm | 5 parts |
| | Atmer 129 (ICI) antistatic agent | 1 part |
| | Quantacure ITX (Ward Blenkinsop) thioxanthone photoinitiator | 1.7 parts |
| | Quantacure EPD (Ward Blenkinsop) aromatic amine photosensitiser | 1.7 parts |
| | methyl ethyl ketone | 150 parts |
| | Backcoat coating composition 11 | |
| a | urethane acrylate (Ebecryl 220: UBC) (hexa-functional compound) | 60 parts |
| b | cyclopentanyl acrylate (Hitachi Chemicals) (mono-functional alicyclic compound) | 26 parts |
| c | Diakon LG156 (ICI) | 14 parts |
| | zinc stearate (Sakai Chem Industries) | 5 parts |
| | talc (Fuji Talc) | 5 parts |
| | Atmer 129 (ICI) | 1 part |
| | Quantacure ITX (Ward Blenkinsop) | 1.7 parts |
| | Quantacure EPD (Ward Blenkinsop) | 1.7 parts |
| | methyl ethyl ketone | 150 parts |
| | Backcoat coating composition 12 | |
| a | dipentaerythritol hexacrylate (Koyeishi Yushi) (hexa-functional compound) | 40 parts |
| a | pentaerythritol triacrylate (Koyeishi Yushi) (tri-functional compound) | 30 parts |
| b | dicyclopentanyl acrylate (Hitachi Chemicals) (mono-functional alicyclic compound) | 20 parts |
| c | Diakon LG156 (ICI) | 10 parts |
| | zinc stearate (Sakai Chem Industries) | 5 parts |
| | talc (Fuji Talc) | 5 parts |
| | Atmer 129 (ICI) | 1 part |
| | Quantacure ITX (Ward Blenkinsop) | 1.7 parts |
| | Quantacure EPD (Ward Blenkinsop) | 1.7 parts |
| | methyl ethyl ketone | 150 parts |
| | Backcoat coating composition 13 | |
| a | urethane acrylate (Ebecryl 220) (hexa-functional compound) | 20 parts |
| a | epoxy acrylate (Ebecryl 600) (di-functional compound) | 55 parts |
| b | cyclohexyl methacrylate (Kyoseisha Yushi) (mono-functional alicyclic compound) | 25 parts |
| | zinc stearate (Sakai Chem Industries) | 5 parts |
| | talc (Fuji Talc) | 5 parts |
| | Atmer 129 (ICI) | 1 part |
| | Quantacure ITX (Ward Blenkinsop) | 1.7 parts |
| | Quantacure EPD (Ward Blenkinsop) | 1.7 parts |
| | methyl ethyl ketone | 150 parts |
| | Backcoat coating composition 14 | |
| a | modified urethane acrylate with polycarbonate (Negami Industries) (di-functional compound) | 50 parts |
| a | trimethylol propane triacrylate (Koyeishi Yushi) (tri-functional compound) | 15 parts |
| b | isobornyl acrylate (Koyeishi Yushi) (mono-functional alicyclic compound) | 20 parts |
| b | dicyclopentanyl acrylate (Hitachi Chemicals) (mono-functional alicyclic compound) | 15 parts |
| | zinc stearate (Sakai Chem Industries) | 5 parts |
| | talc (Fuji Talc) | 5 parts |
| | Atmer 129 (ICI) | 1 part |
| | Quantacure ITX (Ward Blenkinsop) | 1.7 parts |
| | Quantacure EPD (Ward Blenkinsop) | 1.7 parts |
| | methyl ethyl ketone | 150 parts |

Dyesheets 10 to 14 were each prepared from the above dispersion of like number. The appropriate dispersion was coated onto one surface of 6 μm thick polyester base film, the solvent removed and the coating cured using the same procedure as described in Example 1, thereby to provide the base film with a heat resistant backcoat. The dyesheet was then completed by the provision of a dyecoat using the same composition as that used in Example 1.

Scratching and dye migration were evaluated for each dyesheet by using fresh portions of the same receiver sheet, and employing the methods described for Example 1. The results are given in Table 3.

Comparative Examples C to J

A series of further dyesheets (C to J respectively) was prepared in the manner of Example 1, but with alternative backcoats outside the present invention. Composition C in the same as those in Examples 10 and 11 except that the alicyclic monofunctional constituent is replaced by another polyfunctional a-type constituent. Composition D also has the same composition except that the monofunctional constituent does not have any alicyclic group. Similarly, Compositions E and F have been provided as direct comparisons with Example 12, having the same constituents except that the alicyclic monofunctional constituent b is replaced by monofunctional compounds having no alicyclic group in either case. Composition G has been included to show the effect of having only alicyclic monofunctional compounds as the polymerisable constituents, being essentially the same as Example 14 with the two polyfunctional compounds omitted and the quantity of the alicyclic compounds being increased to make up the deficit. In Examples H, I, and J, both of constituents a and b were omitted, leaving just a polymer c, and a curing agent. In detail the comparative compositions were as follows.

| | | |
|---|---|---|
| | Backcoat coating composition C | |
| a | urethane acrylate (Ebecryl 220) (hexa-functional compound) | 60 parts |
| a | polyester diacrylate (Ebecryl 810) (di-functional compound) | 26 parts |
| c | Diakon KG156 (ICI) | 14 parts |
| | zinc stearate (Sakai Chem Industries) | 5 parts |
| | talc (Fuji Talc) | 5 parts |
| | Atmer 129 (ICI) | 1 part |
| | Quantacure ITX (Ward Blenkinsop) | 1.7 parts |
| | Quantacure EPD (Ward Blenkinsop) | 1.7 parts |
| | methyl ethyl ketone | 150 parts |
| | Backcoat coating composition D | |
| a | urethane acrylate (Ebecryl 220) (hexa-functional compound) | 60 parts |
| | stearyl acrylate (Kyoeisha Yushi) (mono-functional compound) | 26 parts |
| c | Diakon KG156 (ICI) | 14 parts |
| | zinc stearate (Sakai Chem Industries) | 5 parts |
| | talc (Fuji Talc) | 5 parts |
| | Atmer 129 (ICI) | 1 part |
| | Quantacure ITX (Ward Blenkinsop) | 1.7 parts |
| | Quantacure EPD (Ward Blenkinsop) | 1.7 parts |
| | methyl ethyl ketone | 150 parts |
| | Backcoat coating composition E | |
| a | dipentaerythritol hexacrylate (Koyeishi Yushi) (hexa-functional compound) | 40 parts |
| a | pentaerythritol triacrylate (Koyeishi Yushi) (tri-functional compound) | 30 parts |
| | phenoxyethyl acrylate (Koyeishi Yushi) (mono-functional compound) | 20 parts |
| c | Diakon LG156 (ICI) | 10 parts |
| | zinc stearate (Sakai Chem Industries) | 5 parts |
| | talc (Fuji Talc) | 5 parts |
| | Atmer 129 (ICI) | 1 part |
| | Quantacure ITX (Ward Blenkinsop) | 1.7 parts |
| | Quantacure EPD (Ward Blenkinsop) | 1.7 parts |
| | methyl ethyl ketone | 150 parts |
| | Backcoat coating composition F | |
| a | dipentaerythritol hexacrylate (Koyeishi Yushi) | 40 parts |

-continued

| | | |
|---|---|---|
| | (hexa-functional compound) | |
| a | pentaerythritol triacrylate (Koyeishi Yushi) (tri-functional compound) | 30 parts |
| | phenoxyethyl acrylate (Koyeishi Yushi) (mono-functional compound) | 20 parts |
| c | Diakon LG156 (ICI) | 10 parts |
| | zinc stearate (Sakai Chem Industries) | 5 parts |
| | talc (Fuji Talc) | 5 parts |
| | Atmer 129 (ICI) | 1 part |
| | Quantacure ITX (Ward Blenkinsop) | 1.7 parts |
| | Quantacure EPD (Ward Blenkinsop) | 1.7 parts |
| | methyl ethyl ketone | 150 parts |
| | Backcoat coating composition G | |
| b | isobornyl acrylate (mono-functional alicyclic compound) | 50 parts |
| b | dicyclopentanyl acrylate (mono-functional alicyclic compound) | 50 parts |
| | zinc stearate (Sakai Chem Industries) | 5 parts |
| | talc (Fuji Talc) | 5 parts |
| | Atmer 129 (ICI) | 1 part |
| | Quantacure ITX (Ward Blenkinsop) | 1.7 parts |
| | Quantacure EPD (Ward Blenkinsop) | 1.7 parts |
| | methyl ethyl ketone | 150 parts |
| | Backcoat coating composition (H) | |
| d | polyvinyl butyral (Eslex BX-1 from Sekisui) | 10 parts |
| c | zinc stearyl phosphate (Sakai Chemical Industry) | 10 parts |
| | talc | 5 parts |
| | Polyisocyanate (curing agent) | 2 parts |
| | methyl ethyl ketone | 120 parts |
| | Backcoat coating composition (I) | |
| d | polyester resin (Vylon 290 from Toyobo) | 20 parts |
| c | aluminium stearyl phosphate (Sakai Chemical Industry) | 10 parts |
| | talc | 5 parts |
| | hexamethoxymethylmelamine | 2 parts |
| | methyl ethyl ketone | 120 parts |
| | Backcoat coating composition (J) | |
| d | ethyl cellulose (Hercules) | 20 parts |
| c | zinc stearate | 5 parts |
| | talc | 5 parts |
| | methyl ethyl ketone | 120 parts |

Comparative coating compositions C-J were used in the same manner as those of the other comparative compositions hereinabove, to make a further set of dyesheets. These were then tested for dye migration (measured as optical density of the transferred dye) and the results are shown in Table 4.

TABLE 3

| Example | Scratching No of streaks | Dye migration reflectivity density |
|---|---|---|
| 10 | >100 | 0.09 |
| 11 | >100 | 0.08 |
| 12 | >100 | 0.06 |
| 13 | >100 | 0.06 |
| 14 | >100 | 0.08 |

TABLE 3

| Example | Scratching No of streaks | Dye migration reflectivity density |
|---|---|---|
| C | >100 | 0.25 |
| D | >100 | 0.35 |
| E | >100 | 0.27 |
| F | >100 | 0.30 |
| G | >100 | 0.20 |

TABLE 3-continued

| Example | Scratching No of streaks | Dye migration reflectivity density |
|---|---|---|
| H | 0 | 0.25 |
| I | 0 | 0.30 |
| J | >100 | 0.30 |

As will be seen from Tables 3 and 4 above, compositions which contained monofunctional compounds having one or more alicyclic groups (Examples 10 to 14) consistently showed lower dye migration than those (Examples C to J) which contained corresponding compositions treated in essentially the same manner, but omitting the alicyclic component or replacing it with a compound having no such alicyclic group.

We claim:

1. A dyesheet for thermal transfer printing, which comprises a base sheet having on one surface a dyecoat containing a thermal transfer dye and a backcoat on the other surface, wherein the backcoat comprises the reaction product of radically copolymerising in a layer of coating composition, the following compounds as essential constituents:

a) at least one organic compound having a plurality of radically polymerisable acrylic or methacrylic groups per molecule, and b) at least one organic compound having per molecule a single acrylic or methacrylic group radically copolymerisable with constituent a, and having at least one alicyclic group per molecule.

2. A dyesheet as claimed in claim 1, characterised in that the composition has the polymerisable constituents a and b in the proportions of a 50–90% and b correspondingly 50–10% by weight.

3. A dyesheet as claimed in claim 1 or claim 2, characterised in that the backcoat composition contains in addition to constituents a and b, at least one slip agent selected from metal salts of long chain carboxylic and phosphoric acids, long alkyl chain esters of phosphoric acid, and long alkyl chain acrylates.

4. A dyesheet as claimed in claim 3, characterised in that the slip agent is a metallic salt of a phosphate ester, which is expressed by the following general formula (A) or (B):

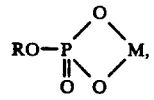

(A)

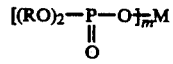

(B)

in which R is an alkyl group of $C_{8-30}$ or an alkylphenyl group, m is an integral number of 2 or 3, and M a metal atom.

5. A dyesheet an claimed claim 4, characterised in that the quantity of slip agent in the composition lies within the range 1–20% by weight of the total amount of the radically polymerisable compounds of constituents a and b.

6. A dyesheet as claimed in any one of the preceding claims, characterised in that in addition to constituents a and b, the backcoat also contains at least one linear organic polymer in amount within the range 1–20% by weight of the total amount of the radically polymerisable compounds of constituents a and b.

* * * * *